US005765712A

United States Patent [19]

Skinner et al.

[11] Patent Number: 5,765,712

[45] Date of Patent: Jun. 16, 1998

[54] TWO CAN BEVERAGE HOLDER

[76] Inventors: Dana Skinner; Susie Skinner, both of P.O. Box 1462, Destin, Fla. 32540

[21] Appl. No.: 850,558

[22] Filed: May 2, 1997

[51] Int. Cl.[6] ..... B65D 25/04

[52] U.S. Cl. ..... 220/501; 220/740; 220/903; 220/504; 220/916; 215/6

[58] Field of Search ..... 220/737, 739, 220/740, 906, 916, 23.83, 23.86, 501, 503, 527, 504, 524, 529, 903; 215/6

[56] References Cited

U.S. PATENT DOCUMENTS

| | | | |
|---|---|---|---|
| 1,942,953 | 1/1934 | Bennett | 220/503 |
| 1,949,677 | 3/1934 | Crawford | 150/52 |
| 2,048,966 | 7/1936 | Perry | 215/6 |
| 3,899,098 | 8/1975 | Hutchins | 220/903 |
| 4,078,686 | 3/1978 | Karesh | 220/916 |
| 4,113,097 | 9/1978 | Finn | 215/6 |
| 4,197,890 | 4/1980 | Simko | 150/2.2 |
| 4,444,324 | 4/1984 | Grenell | 220/916 |
| 4,492,634 | 1/1985 | Villa-Real | 220/916 |
| 4,872,577 | 10/1989 | Smith | 220/85 |
| 5,211,307 | 5/1993 | Jeffries | 220/739 |
| 5,261,554 | 11/1993 | Forbes | 220/740 |
| 5,272,890 | 12/1993 | Penxa | 220/23.83 |
| 5,301,519 | 4/1994 | Howorka | 220/903 |
| 5,335,809 | 8/1994 | Toida | 220/903 |
| 5,564,583 | 10/1996 | Kelley et al. | 220/23.83 |

*Primary Examiner*—Stephen J. Castellano
*Attorney, Agent, or Firm*—Joseph N. Breaux

[57] ABSTRACT

A two can beverage holder including a tubular shaped main cylinder section having a cylinder shaped container compartment formed therein that has an end opening at a first and at a second end thereof, an end cap positionable over either end opening of the main cylinder section, a snap-on carry strap detachably fastenable to the main cylinder section, a snap-on cap strap detachably fastenable between the end cap and the main cylinder section, a zippered pouch detachably securable to the end cap, and a compartment divider member sized to fit within and divide the container compartment of the main cylinder section, the compartment divider member including a washer shaped top section having a first centrally located air flow tube hole, a washer shaped bottom section having a second centrally located air flow tube hole, a tubular shaped air flow tube connected between the first and second air flow tube holes, and a flexible wall member having a first portion permanently secured between perimeter edges of the bottom and top secLions and a second portion positionable between the bottom and top sections, the second portion providing a flexible cover for an access opening into a storage cavity formed within the compartment divider member defined by the bottom section, the top section, the air flow tube, and the wall section.

18 Claims, 2 Drawing Sheets

TWO CAN BEVERAGE HOLDER

TECHNICAL FIELD

The present invention relates to beverage holders and more particularly to a two can beverage holder that includes a tubular shaped main cylinder section having a cylinder shaped container compartment formed therein that has an end opening at a first and at a second end thereof; an end cap positionable over either end opening of the main cylinder section; a snap-on carry strap detachably fastenable to the main cylinder section; a snap-on cap strap detachably fastenable between the end cap and the main cylinder section; a zippered pouch detachably securable to the end cap; and a compartment divider member sized to fit within and divide the container compartment of the main cylinder section; the compartment divider member including a washer shaped top section having a first centrally located air flow tube hole, a washer shaped bottom section having a second centrally located air flow tube hole, a tubular shaped air flow tube connected between the first and second air flow tube holes, and a flexible wall member having a first portion permanently secured between perimeter edges of the bottom and top sections and a second portion positionable between the bottom and top sections, the second portion providing a flexible cover for an access opening into a storage cavity formed within the compartment divider member defined by the bottom section, the top section, the air flow tube, and the wall section.

BACKGROUND OF THE INVENTION

Many times when walking along the beach or other outdoor recreational area it is often desirable to have more than one cool beverage to drink. Although it is desirable to have these beverages they are typically unavailable for purchase in remote locations and, therefore, must be brought along if desired. It would be a benefit, therefore, to have a beverage holder that included an insulated storage compartment for two or more beverage containers that could be easily carried along or, an outdoor excursion. Because it is often desirable to have other items along on these excursions, it would be a further benefit to have a beverage holder that also included a detachable pouch for holding items such as cigarettes, keys and the like. In addition, because it may be desirable to place more valuable items in another location away from the detachable pouch, it would be a further benefit to have a container compartment divider that included a storage cavity therein for secreting small valuable items such as money and jewelry.

SUMMARY OF THE INVENTION

It is thus an object of the invention to provide a two can beverage holder.

It is a further object of the invention to provide a two can beverage holder that includes an insulated storage compartment for two containers that can be easily carried along and used on an outdoor excursion.

It is a still further object of the invention to provide a two can beverage holder that includes a detachable pouch for holding items such as cigarettes, keys and the like.

It is a still further object of the invention to provide a two can beverage holder that has a container compartment divider that includes a storage cavity there n tor secreting small valuable items such as money and jewelry.

It is a still further object of the invention to provide a two can beverage holder that includes a tubular shaped main cylinder section having a cylinder shaped container compartment formed therein that has an end opening at a first and at a second end thereof; an end cap positionable over either end opening of the main cylinder section; a snap-on carry strap detachably fastenable to the main cylinder section; a snap-on cap strap detachably fastenable between the end cap and the main cylinder section; a zippered pouch detachably securable to the end cap; and a compartment divider member sized to fit within and divide the container compartment of the main cylinder section; the compartment divider member including a washer shaped top section having a first centrally located air flow tube hole, a washer shaped bottom section having a second centrally located air flow tube hole, a tubular shaped air flow tube connected between the first and second air flow tube holes, and a flexible wall member having a first portion permanently secured between perimeter edges of the bottom and top sections and a second portion positionable between the bottom and top sections, the second portion providing a flexible cover for an access opening into a storage cavity formed within the compartment divider member defined by the bottom section, the top section, the air flow tube, and the wall section.

It is a still further object of the invention to provide a two can beverage holder that accomplishes some or all of the above objects in combination.

Accordingly, a two can beverage holder is provided. The two can beverage holder comprises includes a tubular shaped main cylinder section having a cylinder shaped container compartment formed therein that has an end opening at a first and at a second end thereof; an end cap positionable over either end opening of the main cylinder section; a snap-on carry strap detachably fastenable to the main cylinder section; a snap-on cap strap detachably fastenable between the end cap and the main cylinder section; a zippered pouch detachably securable to the end cap; and a compartment divider member sized to fit within and divide the container compartment of the main cylinder section; the compartment divider member including a washer shaped top section having a first centrally located air flow tube hole, a washer shaped bottom section having a second centrally located air flow tube hole, a tubular shaped air flow tube connected between the first and second air flow tube holes, and a flexible wall member having a first portion permanently secured between perimeter edges of the bottom and top sections and a second portion positionable between the bottom and top sections, the second portion providing a flexible cover for an access opening into a storage cavity formed within the compartment divider member defined by the bottom section, the top section, the air flow tube, and the wall section.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

DESCRIPTION OF THE EXEMPLARY EMBODIMENT

Figure 1:
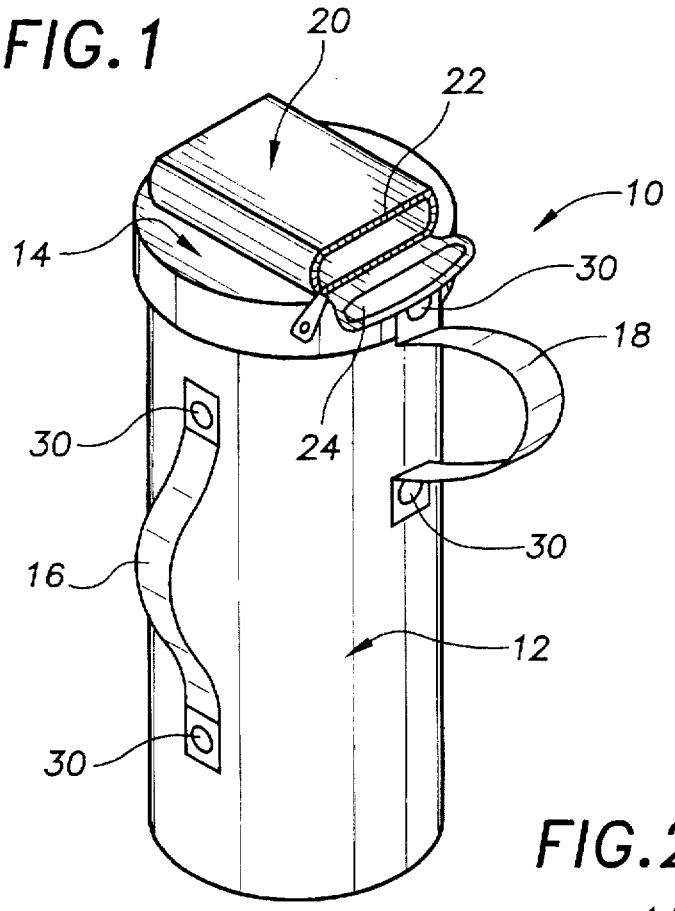
FIG. 1 is a perspective view of the exterior of an exemplary embodiment of the two can beverage holder of the present invention showing the main cylinder section, the end cap positioned over the first end opening of the main cylinder section, the snap-on carry strap, the snap-on cap strap, and the detachable zippered cigarette and lighter pouch.

FIG. 1 shows an exemplary embodiment of the two can beverage holder of the present invention generally designated by the numeral 10. Two can beverage holder 10 includes a main cylinder section, generally designated by the numeral 12; an end cap, generally designated by the numeral 14; a snap-on carry strap 16; a snap-on cap strap 18; a detachable zippered cigarette and lighter pouch, generally designated by the numeral 20; and a compartment divider member, generally designated by the numeral 21 (FIG. 4).

In This embodiment, zippered cigarette and lighter pouch 20 is of conventional stitched cloth construction and sized to receive therein a package of cigarettes and a lighter. Zippered cigarette and lighter pouch 20 includes a zipper closure 22 for sealing a pouch closure 24. A section 26 (FIG. 3) of hook and pile material is provided on a side surface of zippered cigarette and lighter pouch 20 to detachably secure zippered cigarette and lighter pouch 20 to end cap 14. Snap-on carry strap 16 and snap-on cap strap 18 are each lengths of nylon strapping material having snaps 30 provided at the ends thereof for securing them in place. Both snaps 30 of snap-on carry strap 16 are attached to main cylinder section 12. One snap 30 of snap-on cap strap 18 is attached to end cap 14 and the other snap 30 is attached to main cylinder section 12.

Figure 2:
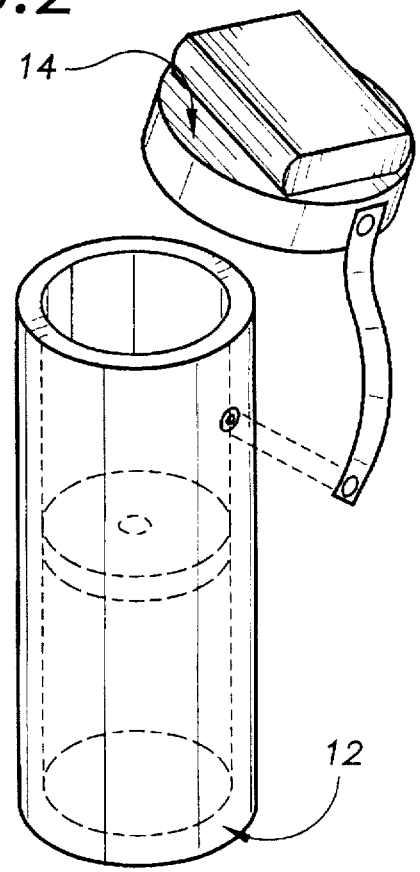
FIG. 2 is a second perspective view of the exemplary two can beverage holder of FIG. 1 showing the main cylinder section with the end cap removed to show the first end opening into the beverage container compartment, the snap-on cap strap detached from the main cylinder section, and an exemplary container compartment divider member.
Figure 3:
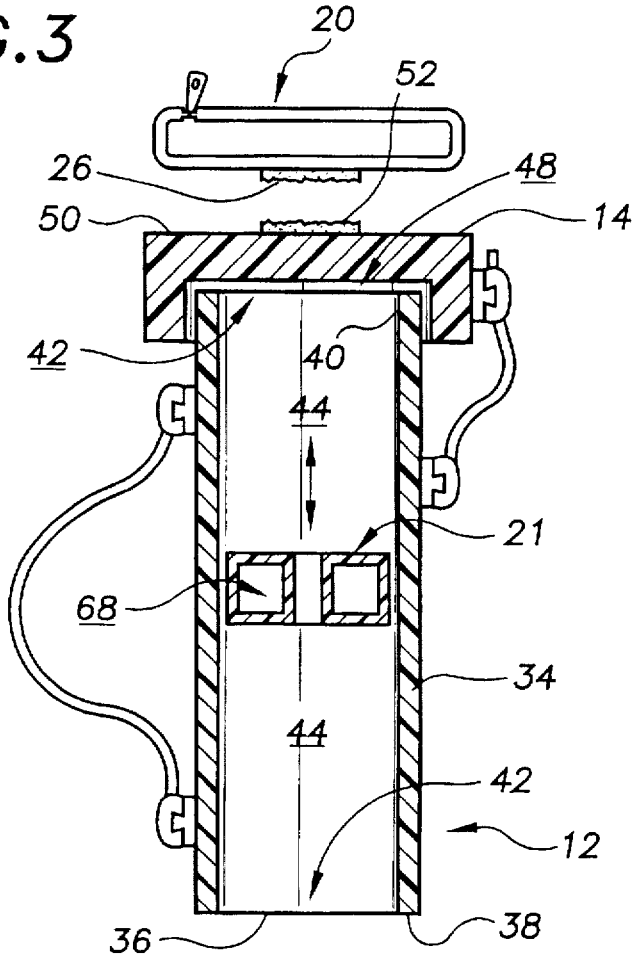
FIG. 3 is a longitudinal cross-section of the two can beverage holder of the present invention showing the container compartment divider member positioned within and dividing the beverage container compartment into a first container compartment and a second container compartment, and the detachable zippered cigarette and lighter pouch detached from the end cap.

Referring now to FIG. 2, main cylinder section 12 and end cap 14 are of insulating, plastic foam construction. Referring now to FIG. 3, main cylinder section 12 is a length of insulating, plastic foam tubing 34 open at either end. A first end 40 and a second end 36 are left open to allow for insertion of items through end openings 42 into cylindrical shaped beverage container compartments 44. End cap 14 is of molded plastic foam construction and shaped in a cap shape with a insertion cavity 48 into which first end 40 or second end 36 is inserted to seal an end opening 42. A top surface 50 of end cap 14 is provided with a section 52 of hook and pile material that is used to form a detachable attachment with the section 24 of hook and pile material of cigarette and lighter pouch 20. Compartment divider member 21 is slidable within container compartment 44.

Figure 4:
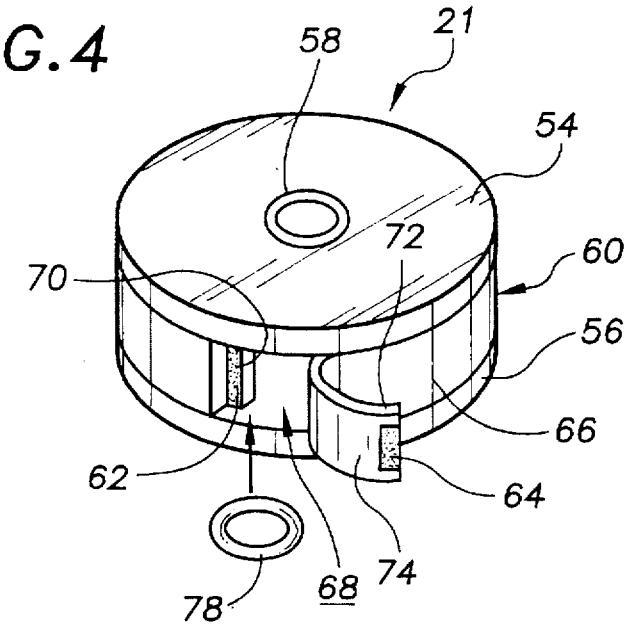
FIG. 4 is a perspective view of a representative ring and the exemplary compartment divider member of FIG. 2 in isolation showing the washer shaped top section, the washer shaped bottom section, the central air flow passage tube, the flexible wall member having a second section functioning as the storage cavity access flap, and the storage cavity into which the representative ring is positionable for storage prior to securing the second section in a closed position with the securing hook and pile fastener strips provided for that purpose.

With reference now to FIG. 4, in this embodiment compartment divider member 21 is of insulating, foam plastic construction and includes a washer shaped top section 54, an identical washer shaped bottom section 56, a central air flow passage tube 58, a flexible wall member, generally designated 60, and first and second securing sections 62,64 of hook and pile fastener material. Washer shaped top section 54, washer shaped bottom section 56, central air flow passage tube 58, and a first section 66 of flexible wall member 60 are cemented together to form a storage cavity 68 (also shown in FIG. 3) within compartment divider member 21. First securing section 62 is adhesively secured to the internal edge 70 of first section 66. Second securing section 64 is adhesively secured to the free end 72 of a second section 74 of flexible wall member 60. Second section 74 is unsecured and acts as a cover for blocking access into storage cavity 68. In use valuable items such as a ring can be stored and concealed in storage cavity 68.

It can be seen from the preceding description that a two can beverage holder has been provided that includes an insulated storage compartment for two or more beverage containers that can be easily carried along on an outdoor excursion; that includes a detachable pouch for holding items such as cigarettes, keys and the like; that includes a storage cavity therein for secreting small valuable items such as money and jewelry; and that includes a tubular shaped main cylinder section having a cylinder shaped container compartment formed therein that has an end opening at a first and at a second end thereof; an end cap positionable over either end opening of the main cylinder section, a snap-on carry strap detachably fastenable to the main cylinder section, a snap-on cap strap detachably fastenable between the end cap and the main cylinder section, a zippered pouch detachably securable to the end cap, and a compartment divider member sized to fit within and divide the container compartment of the main cylinder section, the compartment divider member including a washer shaped top section having a first centrally located air flow tube hole, a washer shaped bottom section having a second centrally located air flow tube hole, a tubular shaped air flow tube connected between the first and second air flow tube holes, and a flexible wall member having a first portion permanently secured between perimeter edges of the bottom and top sections and a second portion positionable between the bottom and top sections, the second portion providing fleible cover for an access opening into a storage cavity formed within the compartment divider member defined by the bottom section, the top section, the air flow tube, and the wall section.

It is noted that the embodiment of the two can beverage holder described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A two can beverage holder comprising:

a tubular shaped main cylinder section constructed of a thermal insulating material and having a cylinder shaped container compartment formed therein that has an end opening at a first and at a second end thereof;

an end cap positionable over either said first and second end opening of said main cylinder section, said end cap being constructed from a thermal insulating material; and a compartment divider member sized to fit within and divide said container compartment of said main cylinder section, said compartment divider member including a washer shaped top section having a first centrally located air flow tube hole, a washer shaped bottom section having a second centrally located air flow tube hole, a tubular shaped air flow tube connected between said first and second air flow tube holes, and a flexible wall member having a first portion permanently secured between perimeter edges of said bottom and top sections and a second portion positionable between said bottom and top sections, said second portion providing a flexible cover for an access opening into a storage cavity formed within said compartment divider member defined by said bottom section, said top section, said air flow tube, and said wall section.

2. The two can beverage holder of claim 1, further including:

a snap-on carry strap detachably fastenable to said main cylinder section.

3. The two can beverage holder of claim 1, further including:

a snap-on cap strap detachably fastenabLe between said end cap and said main cylinder section.

4. The two can beverage holder of claim 1 further including:

a zippered pouch detachably securable to said end cap.

5. The two can beverage holder of claim 1 wherein:

said tubular shaped main cylinder section is constructed of a thermal insulating foam plastic material.

6. The two can beverage holder of claim 1 wherein:

said end cap is constructed from a thermal insulating foam plastic material.

7. The two can beverage holder of claim 2, further including:

a snap-on cap strap detachably fastenable between said end cap and said main cylinder section.

8. The two can beverage holder of claim 7 further including:

a zippered pouch detachably securable to said end cap.

9. The two can beverage holder of claim 8 wherein:

said tubular shaped main cylinder section is constructed of a thermal insulating foam plastic material.

10. The two can beverage holder of claim 9 wherein:

said end cap is constructed from a thermal insulating foam plastic material.

11. The two can beverage holder of claim 3 further including:

a zippered pouch detachably securable to said end cap.

12. The two can beverage holder of claim 11 wherein:

said tubular shaped main cylinder section is constructed of a thermal insulating foam plastic material.

13. The two can beverage holder of claim 12 wherein:

said end cap is constructed from a thermal insulating foam plastic material.

14. The two can beverage holder of claim 3 wherein:

said tubular shaped main cylinder section is constructed of a thermal insulating foam plastic material.

15. The two can beverage holder of claim 14 wherein:

said end cap is constructed from a thermal insulating foam plastic material.

16. The two can beverage holder of claim 4 wherein:

said tubular shaped main cylinder section is constructed of a thermal insulating foam plastic material.

17. The two can beverage holder of claim 16 wherein:

said end cap is constructed from a thermal insulating foam plastic material.

18. The two can beverage holder of claim 5 wherein:

said end cap is constructed from a thermal insulating foam plastic material.

* * * * *